US006520167B1

(12) United States Patent
Kanno

(10) Patent No.: US 6,520,167 B1
(45) Date of Patent: Feb. 18, 2003

(54) ENGINE FOR A MARINE VEHICLE

(75) Inventor: Isao Kanno, Shizuoka (JP)

(73) Assignee: Sanshin Kogyo Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/629,298

(22) Filed: Jul. 31, 2000

(30) Foreign Application Priority Data

Jul. 30, 1999 (JP) ..... 11-217777

(51) Int. Cl.[7] ..... F02D 41/00; F02M 51/00

(52) U.S. Cl. ..... 123/674; 123/480; 123/679; 701/103; 440/89

(58) Field of Search ..... 123/674, 679, 123/687, 478, 479, 480; 701/102, 103, 105, 110; 440/1, 89

(56) References Cited

U.S. PATENT DOCUMENTS

| | | | | | |
|---|---|---|---|---|---|
| 4,201,161 | A | * | 5/1980 | Sasayama et al. | 123/675 |
| 4,517,949 | A | * | 5/1985 | Ito et al. | 123/674 |
| 4,541,388 | A | * | 9/1985 | Ujihashi et al. | 123/486 |
| 4,589,392 | A | * | 5/1986 | Wirz | 123/357 |
| 4,664,086 | A | * | 5/1987 | Takeda et al. | 123/674 |
| 5,918,275 | A | | 6/1999 | Kato et al. | 73/116 |
| 5,941,743 | A | * | 8/1999 | Kato | 440/1 |
| 5,983,878 | A | | 11/1999 | Nonaka et al. | 123/687 |
| 6,058,907 | A | | 5/2000 | Motose et al. | 123/305 |

FOREIGN PATENT DOCUMENTS

| | | | | |
|---|---|---|---|---|
| JP | 58-150071 | * | 9/1983 | F02P/5/04 |
| JP | 59-201941 | * | 11/1984 | F02D/5/02 |
| JP | 61-87941 | * | 5/1986 | F02D/41/40 |
| JP | 61-210250 | * | 9/1986 | F02D/41/34 |
| JP | 4-203236 | * | 7/1992 | F02D/41/14 |
| JP | 5-59988 | * | 3/1993 | F02D/41/14 |

* cited by examiner

*Primary Examiner*—Hieu T. Vo
(74) *Attorney, Agent, or Firm*—Knobbe, Martens, Olson & Bear, LLP

(57) ABSTRACT

An engine for a marine vehicle includes a controller having a predetermined map defining a relationship between a fuel injection parameter and an engine operation characteristic. Additionally, the controller includes at least one compensation factor for adjusting the fuel injection parameter. The compensation value is derived from data recorded during a test of the engine. The compensation factor is used during the normal operation of the engine to achieve a predetermined air/fuel ratio.

28 Claims, 6 Drawing Sheets

ENGINE FOR A MARINE VEHICLE

PRIORITY INFORMATION

This application is based on and claims priority to Japanese Patent Application No. 11-217777, filed Jul. 30, 1999.

BACKGROUND OF THE INVENTION

1. Field of the Invention

The present invention relates to an engine for a marine vehicle. More specifically, the present invention relates to an improved feedback control system for the engine of a marine vehicle.

2. Description of Related Art

In all fields of engine design, there is an increasing emphasis on obtaining more effective emission control, better fuel economy and, at the same time, continued high or higher power output. In pursuit of better fuel economy and emission control, various types of control systems have been developed in conjunction with internal combustion engines. One of the more effective types of controls is so-called "feedback" control. With this type of control, a basic air/fuel ratio is set for the engine. Adjustments are then made from the basic setting based on the output of a sensor that senses the air/fuel ratio in the combustion chamber in order to bring the air/fuel ratio into the desired range.

Normally, the type of sensor employed for such feedback control is an oxygen ($O_2$) sensor which outputs an electrical signal indicative of the oxygen present in exhaust gases resulting from combustion within the combustion chambers of the engine. Generally, when the output signal voltage is high, little oxygen is present in the exhaust gasses, indicating that a combusted air/fuel charge was rich in fuel. On the other hand, when the output signal voltage is low, substantial amounts of oxygen are present in the exhaust, thus indicating that a combusted charge was rich in air.

A conventional oxygen sensor is normally associated with a wave forming circuit which manipulates the output of the sensor to indicate an "on" signal when the voltage of the output signal exceeds a reference voltage (i.e., a signal which results when the supplied charge is rich in fuel). On the other hand, the circuit manipulates the signal to indicate that the sensor is "off" when the voltage of the output signal does not exceed the reference voltage (i.e., a signal which results from a supplied air/fuel charge which is rich in air).

The control operates on a feedback control principle, continuously making corrections to accommodate deviations from the desired or "target" air/fuel ratio. Adjustments are made in stepped intervals until the sensor output goes to the opposite sense from its previous signal. For example, if the mixture is too rich in fuel (i.e., the sensor signal is "on"), then lean adjustments are made until the mixture strength is sensed to be lean (i.e., the sensor signal turns "off"). Adjustments are then made back into the rich direction in order to approximately maintain the desired ratio.

Most commonly, the oxygen sensor is the type which utilizes inner and outer platinum coated electrodes. Other commonly used oxygen sensors include Yttria ($Y_2O_3$), stabilized Zirconia ($Z_rO_2$) or Titania ($T_iO_2$) electrode sensors. Additionally, Universal Exhaust Gas Oxygen sensors (UEGO sensors) have recently been developed and are based on a heated conventional Zirconia sensor. The UEGO sensors are able to measure a wide range of air/fuel ratios including a very rich mixture (i.e., 10:1) to a very lean mixture (i.e., 35:1).

Such conventional oxygen sensors include an inner electrode exposed to combustion gases of the engine and an outer electrode exposed to atmospheric air. The oxygen sensor uses ambient air as a basis for determining whether oxygen is present in the exhaust gases, as is known in the art.

SUMMARY OF THE INVENTION

One aspect of the present invention includes the realization that known engine sensor assemblies, such as oxygen sensor assemblies, have proven to be inadequate. In particular, it has been found that known combustion condition sensors can have a relatively short useful life span due to the typical operating environments of marine vehicles. For example, as is well known in the art, marine engines typically discharge exhaust gases to the body of water in which the marine vehicle is operating, at a point below the surface of the water, thereby mixing exhaust gases with water upon discharge. Additionally, many 2-stroke engines for marine vehicles are configured to inject water into exhaust gases flowing through the exhaust system immediately downstream of an expansion chamber, to thereby cool the exhaust gases and provide beneficial effects with respect to the tuning of the exhaust system. However, because such exhaust systems can allow saltwater to flow within the exhaust system and possibly to the extreme upstream end of the exhaust system, such saltwater can reach the inner electrode of an oxygen sensor disposed in the exhaust system. The interaction of saltwater with the various exotic and other dissimilar metals used to construct the exhaust system and the oxygen sensor, causes corrosion and ultimately destroys the oxygen sensor.

Other known oxygen sensor assemblies expose the inner electrode of the oxygen sensor to a conduit leading directly to a combustion chamber within the engine. Although this design better protects the oxygen sensor from water that may be present in the exhaust system, other problems are raised. For example, where the oxygen sensor is directly exposed to the combustion chamber, unburnt hydrocarbons may be pushed into contact with the inner electrode, thereby affecting the performance of the sensor. Additionally, the outer electrode is still exposed to ambient air. As such, other problems are raised in allowing ambient air to contact the outer electrode while preventing water from reaching the outer electrode. Thus, it is desirable to provide a control system for an engine of a marine vehicle which reduces the cost of maintenance and manufacturing and extends the operational life of the engine.

Another aspect of the invention includes the realization that although numerous components of an engine for a marine vehicle may be mass produced with a high level of precision, differences result in the operational characteristics of such components despite efforts to maintain consistency of mass produced items. For example, but without limitation, fuel injectors typically include a solenoid which drives a spring biased valve which is biased to a closed position. The springs are mass produced. However, although the springs may appear to be identical, variations have been found between identically sized springs, which results in a difference in the corresponding spring constant. These differences cause the fuel injectors to behave differently from one another, i.e., the speed at which the valve closes according to its bias. Additionally, it has been found that the injection port diameters of one engine body may be different from the injection port diameters of another engine body which are mass produced on the same manufacturing line. These differences, among others, can affect the performance of the fuel injector, and thus the air/fuel ratio delivered to combustion chamber.

Thus, according to another aspect of the invention, an engine for a marine vehicle includes an engine body defining at least one combustion chamber and the fuel injection system. The fuel injection system is configured to form fuel charges for combustion in the combustion chamber. The engine also includes a controller for controlling fuel injection parameters. The controller includes a memory having a predetermined map which includes fuel injection parameters. The controller includes compensation values derived from a test of the engine during operation and defines a fuel injection compensation value as a function of at least one engine operation characteristic. The fuel injection compensation value is determined by operating the engine, detecting a combustion condition of the engine over a range of engine speeds, and determining the fuel injection compensation value which corresponds to a predetermined air/fuel ratio.

By including a compensation value which is derived from a test of the engine itself, the present engine is more accurately controlled because the controller can compensate for the various differences existing in mass produced components, such as springs and injection port diameters.

According to another aspect of the invention, a method for adjusting an engine controller of a marine vehicle engine comprises installing a combustion condition sensor on an engine so as to expose a portion of the sensor to combustion gases within the engine. The engine is then operated using the combustion condition sensor in a feedback control scenario during which a fuel injection compensation value is determined which corresponds to a pre-determined air/fuel ratio. The combustion condition sensor can then be removed and the engine can then be operated without the sensor. Preferably, the combustion condition sensor is an oxygen sensor.

By adjusting an engine controller in accordance with the present method, the controller can compensate for the varying differences present in mass produced components and the cost of the engine can thereby be reduced because the engine does not need to have a combustion condition sensor, such as an oxygen sensor, for example. Furthermore, since the engine controller does not rely oil a combustion condition sensor for operation, the life span of the engine is extended since combustion condition sensors, such as oxygen sensors, typically suffers greatly from corrosion caused by water in the ambient environment in which a marine vehicle is operating, as well as water present in the exhaust system thereof.

Further aspects, features and advantages of the present invention will become apparent from the detailed description of the preferred embodiments which follow.

BRIEF DESCRIPTION OF THE DRAWINGS

The features mentioned in the summary of the invention, as well as other features of the invention, will now be described with reference to the drawings of a preferred embodiment of an engine for a marine vehicle. The illustrated embodiment is intended to illustrated, but not to limit, the invention. The drawings contain the following figures.

DETAILED DESCRIPTION OF THE PREFERRED EMBODIMENTS OF THE INVENTION

An improved engine controller for an engine of a marine vehicle is disclosed herein. The engine includes an improved controller which avoids the need for expensive and water sensitive components. Although the engine is illustrated as being installed on an outboard motor 10, the engine can be used with any vehicle using an internal combustion engine, such as, for example, but without limitation, personal watercraft, small jetboats, off-road vehicles, circle track racing vehicles, automobiles, and heavy construction equipment.

Figure 1:
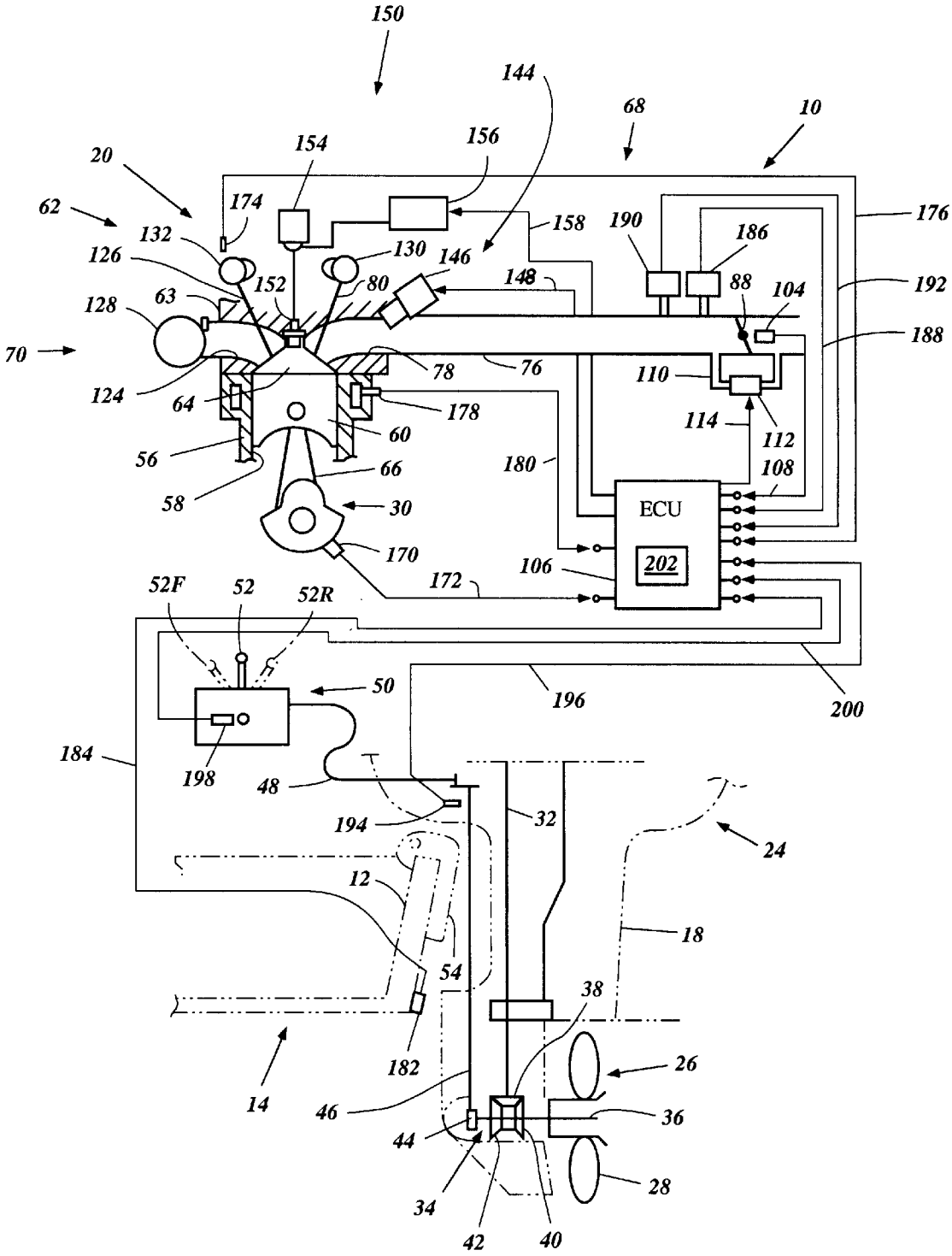
FIG. 1 is a multi-part view showing: in the lower portion, an outboard motor that employs an engine which relates to the present invention; and in the upper view, a partially schematic cross-sectional view of the engine of the outboard motor with its air induction, fuel injection, and exhaust system shown in part schematically. An ECU (electronic control unit) for the motor links the two views together.

In the lower portion view of FIG. 1, the outboard motor 10 is partially illustrated as being mounted to a transom 12 of a marine vehicle 14. The entire outboard motor 10 is not depicted. For example, the swivel bracket that is typically associated with an outboard motor is not illustrated. This and other components, not specifically identified herein, are well known in the art and the specific method by which the outboard motor 10 is mounted to the transom 12 of the watercraft 14 is not necessary to prevent those skilled in the art to understand or practice the invention.

Figure 2:
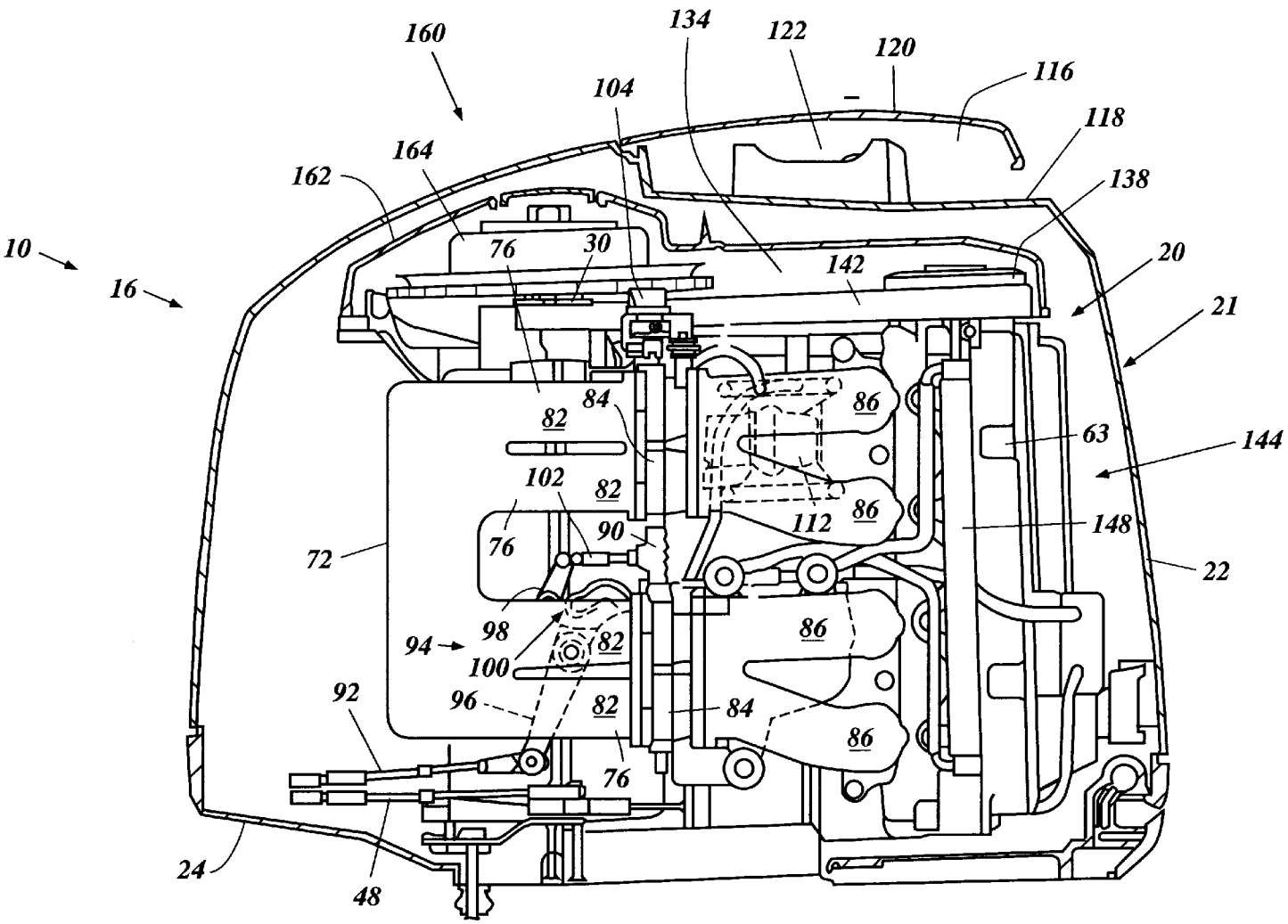
FIG. 2 is a partial left side elevational view of the outboard motor shown in FIG. 1 with an upper and lower cowling member of the outboard motor shown in section.

With reference to FIG. 2, the outboard motor 10 includes a powerhead 16 positioned above a drive shaft housing 18 (FIG. 1) and which includes an internal combustion engine, indicated generally by the reference numeral 20. The engine 20 is shown in more detail in the upper view of FIG. 1 and is described in more detail below.

The powerhead 16 is surrounded by a protective cowling 21 that includes a main cowling member 22 and a lower cowling member or a "lower tray" 24. The main cowling member 22 is detachably fixed to the lower tray portion 24. The lower tray portion 24 encloses an upper portion of the driveshaft housing 18.

With reference to FIG. 1, positioned beneath the drive shaft housing 18, a lower unit 26 is provided in which a propeller 28, which forms the propulsion device for the associated watercraft, is journaled.

As is typical with outboard motor practice, the engine 20 is supported in the powerhead 16 so that its crankshaft 30 (see upper view of FIG. 1) rotates about a vertically extending axis. This facilitates connection of the crankshafts 30 to a drive shaft 32 (see lower view of FIG. 1) which depends into the drive shaft housing 18. The drive shaft 32 drives the propeller 28 through a conventional forward, neutral, reverse transmission 34 contained in a lower unit 26. The transmission 34 is provided between the drive shafts 32 and a propeller shaft 36. The transmission 34 couples together the drive shaft 32 and the propeller shaft 36, which lie generally normal to each other (i.e., at a 90° angle) with a bevel gear combination. In the illustrated embodiment, the bevel gear combination includes a drive bevel gear 38 driven by the drive shaft 32, and two driven bevel gears 40, 42. The driven bevel gears 40, 42 arc moved into and out of engagement with the drive bevel gear 38 to effect forward and reverse thrust. The movement of the bevel gears 40, 42 is effected by a dog clutch 44. In the illustrated embodiment, the dog clutch 44 moves the driven bevel gears 40, 42 to shift the rotational directions of the propeller 28 between forward, neutral and reverse.

The dog clutch 44 includes a shift cam (not shown). A shift rod 46 is connected to a shift cable 48. The shift rod 46 extends generally vertically through the drive shaft housing 18 and the lower unit 26, while the shift cable 48 extends outwardly from the lower cowling 24 and is connected to a shift unit 50 which includes a lever 52. The lever 52 is movable between a neutral position (illustrated in solid lines), a forward position 52F (illustrated in phantom lines) and a reverse position 52R (illustrated in phantom lines). The lever 52 is operable by the operator when the operator wants to shift the transmission 34 directions.

The outboard motor 10 also includes a bracket assembly 54. Although schematically shown in FIG. 1, the bracket assembly 54 comprises a swivel bracket and a clamping bracket. The swivel bracket supports the outboard motor 10 for pivotal movement about a generally vertically extending steering axis. The clamping bracket, in turn, is affixed to the transom 12 of the watercraft 14 and supports the swivel bracket for pivotal movement about a generally horizontally extending axis. A hydraulic tilt system can be provided between the swivel bracket and the clamping bracket to tilt up or down the outboard motor 10. If this tilt system is not provided, the operator may tilt the outboard motor 10 manually. Since the construction of the bracket assembly 54 is well known in the art, a further description is not believed to be necessary to enable those skilled in the art to practice the invention. As used throughout this description, the terms "forward," "front," and "fore" mean at or to the side of the bracket assembly 54, and the terms "rear," "reverse," and "rearwardly" mean at or to the opposite side of the front side, unless indicated otherwise.

With reference to the upper view of FIG. 1, the engine 20 operates on a 4-stroke combustion principle, The engine 20 includes a cylinder block 56. In the illustrated embodiment, the cylinder block 56 defines four cylinder bores 58 which are generally horizontally extending and spaced generally vertically from each other. As such, the engine 20 is an L4 (inline 4 cylinder) type. A piston 60 reciprocates in each cylinder bore 58. It is to be noted that the engine may be of any type (V-type, W-type), may have other numbers of cylinders and/or may operate under other principles of operation (2-stroke, rotary, or diesel principles).

A cylinder head assembly 62 is affixed to one end of the cylinder block 56. The cylinder head assembly 62 includes a cylinder head 63 and defines four combustion chambers 64 with the pistons 60 and the cylinder bores 58. The other end of the cylinder block 56 is closed with a crankcase member (not shown) defining a crankcase chamber.

The crankshaft 30 extends generally vertically through the crankcase chamber. The crankshaft 30 is connected to the pistons 60 by connecting rods 66 and rotates with the reciprocal movement of the pistons 60 within the cylinder bores 58. The crankcase member is located at the forward-most position of the powerhead 16, and the cylinder block 56 and the cylinder head assembly 62 extend rearwardly from the crankcase member.

The engine 20 also includes an air induction system 68 and an exhaust system 70. The air induction system 68 is configured to supply air charges to the combustion chambers 64.

Figure 3:
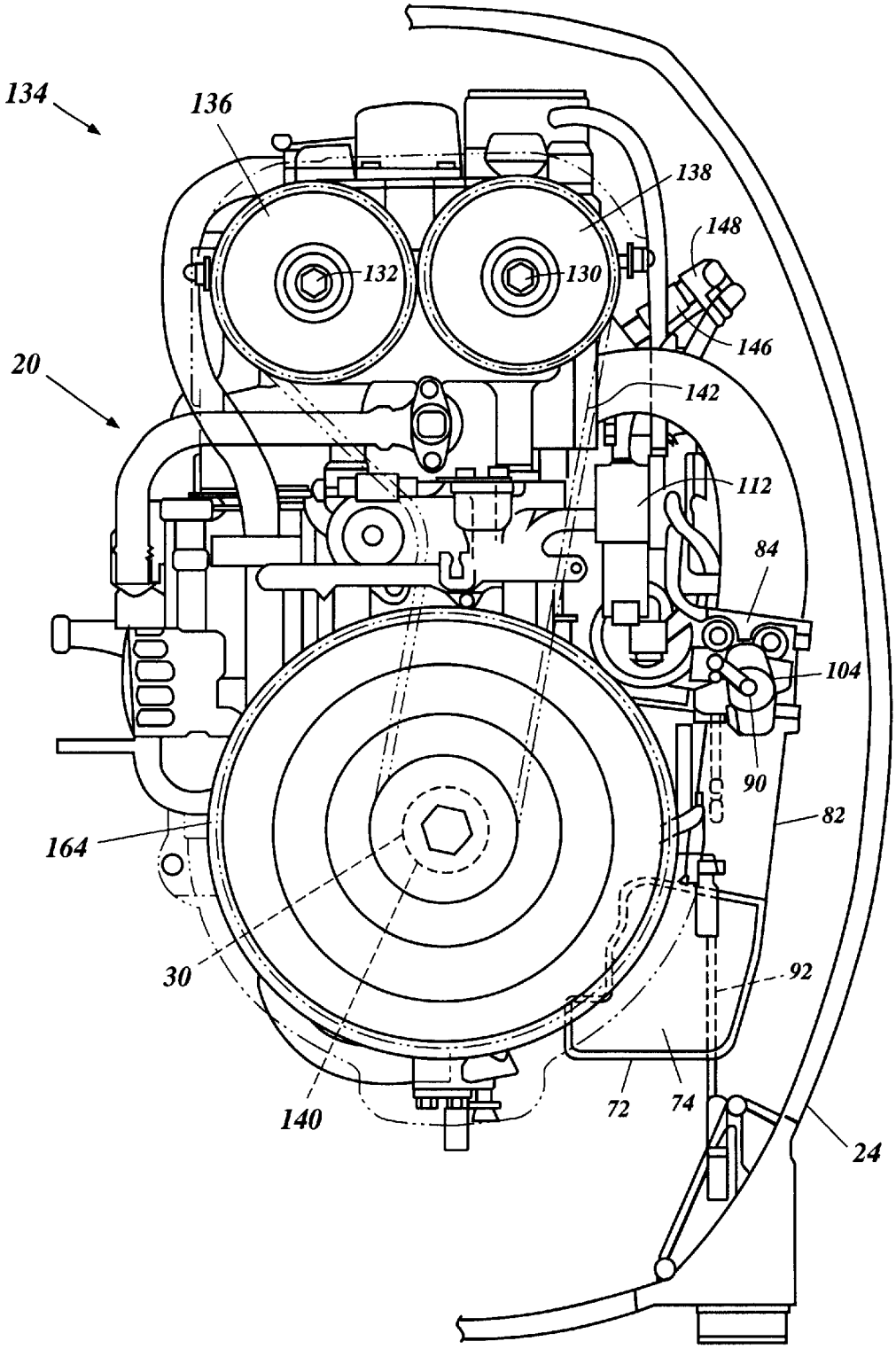
FIG. 3 is a top plan view of the engine shown in FIG. 2. The upper cowling is removed and the lower cowling is shown partially.

With reference to FIGS. 2 and 3, the induction system 68 includes a plenum chamber member 72 which defines a plenum chamber 74 therein. Four main intake passages 76 extend from the plenum chamber 74 to a corresponding number of intake ports 78 (FIG. 1) formed on the cylinder head assembly 62.

The intake ports 78 are opened and closed by intake valves 80. When the intake ports 78 are opened, air from the intake passages 76 and intake ports 78 flows into the combustion chambers 64.

The plenum chamber 74 is positioned on the port side of the crankcase member. The plenum chamber 74 has an inlet opening (not shown) that opens to the interior of the cowling 22 at its front side. The plenum chamber member 72 functions as an intake silencer and/or a collector of air charges. The air intake passages 76 extend rearwardly from the plenum chamber 74 along the cylinder block 56 and curve toward the intake ports 78. The respective intake passages 76 are vertically spaced apart from each other.

With reference to FIG. 2, the air intake passages 76 are defined by duct sections 82, throttle bodies 84, and runners 86. In the illustrated embodiment, the duct sections 82 are formed integrally with the plenum chamber member 72.

As shown in FIG. 2, the upper two throttle bodies 84 are integrated with each other. The upper two intake runners 86 are also integrated with each other at their fore portions and then forked into two separate portions. The lower two throttle bodies 84, as viewed in FIG. 2, and the corresponding lower two intake runners 86, have the same construction as the upper two throttle bodies 84 and intake runners 86, respectively.

The respective throttle bodies 84 support throttle valves 88 (FIG. 1) therein for pivotable movement about valve shafts (not shown) which extend generally vertically. The valve shafts are linked together to form a single valve shaft assembly 90 that passes through the throttle bodies 84.

The throttle valves 88 are operable via a throttle cable 92 and a non-linear control mechanism 94. The throttle cable 92 is connected to a throttle lever (not shown). Optionally, the shift lever 52 can be constructed so as to operate as both a shift lever for operating the transmission 34 and the non-linear control mechanism 94.

The non-linear control mechanism 94 includes a first lever 96 connected to a second lever 98, which are joined together through a cam connection 100. The first lever 96 is pivotally connected to the throttle cable 92 and also to a first pivot pin connected to the crankcase member. The first lever also defines a cam hole at the end of the first lever 96 opposite the throttle cable 92. The second lever 98 is generally shaped as the letter "L" and is pivotally connected to a second pin which is affixed to the crankcase member. The second lever has a pin that reciprocates within the cam hole. The other end of the second lever is connected to a control rod 102. The control rod 102, in turn, is pivotally connected to a lever member which is connected to the throttle valve shaft assembly 90 via a torsion spring (not shown) that urges the control rod 102 to a closed position.

A throttle valve position sensor 104., as shown in FIGS. 1 and 2, is arranged atop of the throttle valve shaft assembly 90. A signal from the throttle valve position sensor 104 is directed to an ECU 106 via a throttle valve position signal line 108 for use in controlling various aspects of engine operation including, for example, but without limitation, fuel injection control which will be described later. The signal from the throttle valve position sensor 104 corresponds to the engine load in one aspect, as well as the throttle opening. The ECU 106 is described in detail below.

The air induction system 68 further includes a bypass passage or idle air supply passage 110 (FIG. 1). An idle air adjusting unit 112 is disposed in the bypass passage 110 for controlling air flow therethrough. The idle air adjusting unit 112 is connected to the ECU 106 via an idle air control line 114.

With reference to FIG. 2, and as noted above, the upper cowling 22 is detachably affixed to the lower cowling 24 so as to generally completely enclose the engine 20. The upper cowling 22 includes an air intake compartment 116 defined between a top surface 1118 of the upper cowling 22 and a cover member 120. The intake compartment 116 has an air inlet duct 122 that connects the space in the compartment 116 and the interior of the cowling 21.

In operation, air is introduced into the air intake compartment 116 and enters the interior of the cowling 21 through the air inlet duct 122. The air then passes through the inlet opening of the plenum chamber member 72 and enters the plenum chamber 74. During idle of the engine 20, an air charge amount is controlled by the throttle valves to meet the requirements of the engine 20. Tile air charge then flows through the runners 86 and to the intake ports 78 (FIG. 1).

As described above, the intake valves 80 are provided at the intake ports 78. When the intake valves are opened, the air supplied to the combustion chambers 64 has an air charge. Under the idle running condition, the throttle valves are generally closed. The air, therefore, enters the port 78 through the idle air adjusting unit 112 which is controlled by the ECU 106. The idle air charge adjusted in the adjusting unit has been supplied to the combustion chambers 64 via the intake ports 78.

The exhaust system 70 is configured to discharge or guide burnt charges or exhaust gases outside of the outboard motor 10 from the combustion chamber 64. Exhaust ports 124 are defined in the cylinder head assembly 62 and are opened and closed by exhaust valves 126. When the exhaust ports 124 are opened, the combustion chambers 64 communicate with a single or multiple exhaust passages 128 which lead the exhaust gases downstream through the exhaust system 62.

Preferably, the exhaust system 70 includes an underwater, high speed exhaust gas discharge and an above water, low speed exhaust gas discharge. Since these types of systems are well known in the art, a further description of the exhaust system is not believed to be necessary to prevent those skilled in the art to practice the invention.

An intake camshaft 130 and an exhaust camshaft 132 are provided to control the opening and closing of the induction valves 80 and exhaust valves 126, respectively. The camshafts 130, 132 extend approximately vertically and parallel with each other. The camshafts 130, 132 have cam lobes that act against the valves 80, 126 at predetermined timings to open and close the respective ports. The camshafts 130, 132 are journaled on the cylinder head assembly 62 and are driven by the crankshaft 30 via a camshaft drive unit 134 (FIG. 2).

In the illustrated embodiment, the camshaft drive unit 134 is positioned at the upper end of the engine 20, as viewed in FIG. 2. With reference to FIG. 3, the camshaft drive unit 134 includes sprockets 136, 138 mounted to an upper end of the camshafts 130, 132, respectively. The crankshaft 30 also includes a sprocket 140 at an upper end thereof. A timing belt or chain 136 is wound around the sprockets 136, 138, 140. As the crankshaft 30 rotates, the camshafts 130, 132 are thereby driven.

With reference to FIGS. 1 and 2, the engine 20 also includes a fuel injection system 144. The fuel injection system 144 includes four fuel injectors 146 which have injection nozzles exposed to the intake ports 78 so that injected fuel is directed toward the combustion chamber 64. A main fuel supply tank (not shown) is part of the fuel injection system and is placed in the hull of the associated watercraft 14. Fuel is drawn from the fuel tank through a series of fuel pumps and preferably, a vapor separator (not shown). A high pressure fuel pump (not shown) draws fuel from the vapor separator and delivers highly pressurized fuel to a fuel rail 148 (FIG. 2). Preferably, a fuel return conduit (not shown) is also provided between the fuel injectors 146 or the fuel rail 148 and the vapor separator. A pressure regulator (not shown) preferably regulates the pressure within the fuel injection system 144.

In operation, a predetermined amount of fuel is sprayed into the intake ports 78 via the injection nozzles of the fuel injectors 146. The timing and duration of the fuel injection is dictated by the ECU 106. The fuel charge delivered by the fuel injectors 146 then enters the combustion chambers 64 with an air charge at the moment the intake valves 80 are opened. Since the fuel pressure is regulated, a duration during which the nozzles of the injectors are opened is a factor determined by the ECU 106 to measure an amount of fuel to be injected by the fuel injectors 146. The duration and injection timing are thus controlled by the ECU 106 through a fuel injector control line 148. Preferably, the fuel injectors 146 are operated by solenoids (not shown) as is known in the art. Thus, the fuel injector control line 148 signals the solenoids to open spring loaded valves within the fuel injectors according to the timing and duration determined by the ECU 106.

The engine 20 further includes an ignition system, indicated generally by reference numeral 150. Four spark plugs 152 are affixed on the cylinder head assembly 62 and are exposed into the respective combustion chambers 64. The spark plugs 152 ignite an air/fuel charge at a certain timing as determined by the ECU 106 to burn the air/fuel charge therein. For this purpose, the ignition system 150 includes an ignition coil 154 interposed between the spark plugs 152 and the ECU 106. In the illustrated embodiment, the ignition system 150 also includes an ignitor 156 disposed between the ignition coil 154 and the ECU 106. An ignition control line 158 connects the ignitor 156 and the ECU 106. Control signals from the ECU 106 are delivered to the ignitor 156 via the control line 158.

With reference to FIG. 2, the flywheel assembly 160 is affixed to an upper end of the crankshaft 30. A cover member 162 covers the flywheel assembly 160, sprockets 130, 132, 140 and the belt 142 so as to prevent debris and/or foreign materials from becoming entrained in the sprockets 130, 132, 140 and to protect an operator from moving components when the upper cowling 22 is removed. The flywheel assembly 160 also includes an AC generator that generates electric power. The generated AC power is led to a battery (not shown) through a rectifier that rectifies the AC power to DC power. The battery accumulates electrical energy therein and also supplies it to electrical equipment including the ECU 106, the solenoids of the fuel injectors 146 and the ignition coil 154.

While not illustrated, the engine 20 can also include a recoil starter to drive the flywheel assembly 160 when starting the engine 20. A starter motor can be employed in addition or in the alternative to the recoil starter for the same purpose. The use of a starter motor is preferred when the present invention is employed with larger size engines. The recoil starter is operated by an operator of the watercraft 14 when the operator wants to start the engine 20. For example, the starter motor may be activated when a main switch is actuated by the operator of the watercraft 14.

Preferably, the ECU 106 controls the timing and duration of fuel injection from the fuel injectors 146 and the timing of the firing of the spark plugs 152 according to a feedback control scenario. A number of sensors, in addition to the throttle position sensor 104, are configured to output signals indicative of corresponding various conditions including, for example, but without limitation, engine operation conditions, ambient conditions or other conditions of the outboard motor 10 that affect engine performance.

Certain sensors are schematically represented in FIG. 1. For example, an engine speed sensor 170 is mounted in the vicinity of the crankshaft 30 and/or a flywheel 164 which is also attached to the crankshaft 30. The engine speed sensor 170 outputs a signal indicative of the position of the crankshaft 30 and/or the speed of rotation of the crankshaft 30. The signal from the engine speed sensor 170 is transferred to the ECU 106 via a crankshaft position dataline 172.

A crankshaft position sensor 174 is mounted in the vicinity of one of the camshafts 130, 132 in order to determine the status of the engine, i.e., whether the crankshaft 30 is in an intake and compression rotation or a power and exhaust rotation. For example, since a 4-cycle engine fires its fuel injectors 146 and spark plugs 152 only once for every two rotations of the crankshaft 30, the camshafts 130, 132 rotate only once for every two revolutions of the crankshaft 30. Thus, a crankshaft position sensor 174 can be used to determine the status of the engine since it is mounted in the vicinity of one of the camshafts 130, 132.

The output signals from the crankshaft position sensor 174 is transferred to the ECU 106 via a crankshaft position dataline 176. As such, the ECU 106 can receive the output signal from the crankshaft position sensor 174 for the use in determining proper fuel injection timing and spark plug firing, for example.

An engine temperature sensor 178 can be connected to the engine 20 in order to detect the temperature of the engine 20. In the illustrated embodiment, the engine temperature sensor 178 is connected to a cooling jacket formed in the cylinder block 56 so as to detect the temperature of engine coolant flowing therethrough. The engine temperature sensor 178 is connected to the ECU 106 via an engine temperature dataline 180. As such, the ECU 106 can receive a signal from the engine temperature sensor 178 indicative of the temperature of the cylinder block 56.

A watercraft speed sensor 182 can be connected to the watercraft 14 for detecting a speed of the watercraft 14. The watercraft speed sensor 182 is connected to the ECU 106 via a watercraft speed dataline 184. As such, the ECU 106 can receive a signal from the watercraft speed sensor 184 that is indicative of the speed of the associated watercraft 14.

An intake air temperature sensor 186 can be connected to the induction system 68 to detect the temperature of the air present in the induction system 68. In the illustrated embodiment, the intake air temperature sensor 186 is connected to the intake passage 76, downstream from the throttle valve 88. The intake air temperature sensor 186 is connected to the ECU 106 via intake air temperature dataline 188. As such, the ECU 106 can receive a signal from the intake air temperature sensor 186 that is indicative of the temperature of air present in the induction passage 76.

An intake air pressure sensor 190 can also be connected to the induction system 68. In the illustrated embodiment, the intake air pressure sensor 190 is connected to the intake passage 76 so as to detect a pressure of the intake air present in the intake passage 76. The induction air pressure sensor 190 is connected to the ECU 106 via an air pressure dataline 192. As such, the ECU 106 can receive a signal from the intake air pressure sensor 190 that is indicative of the pressure within the intake passage 76.

The transmission position sensor 194 can be connected to a point on the outboard motor 10 so as to detect a position of the transmission 34. In the illustrated embodiment, the transmission position sensor 194 is positioned at an upper end of the shift rod 46 so as to detect the state of the transmission 34, i.e., whether the transmission 34 is in a forward, neutral, or a reverse state. The transmission position sensor 194 is connected to the ECU 106 via a transmission position dataline 196. As such, the ECU 106 can receive a signal from the transmission position sensor 194 which is indicative of a position of the transmission 34.

Optionally, a throttle lever position sensor 198 can be mounted to the lever assembly 50 when the assembly 50 is configured to provide the dual functions of a throttle lever and a shift lever. In this mode, the lever position sensor 198 is a rheostat and thus can detect a position of the lever 52 proportionally between the positions 52, 52F, and 52R. The lever position sensor 198 is connected to the ECU 106 via lever position dataline 200. As such, the ECU 106 can receive a signal from the lever position sensor 198 which is indicative of a proportional position of the lever 52. In this mode, the ECU 106 can drive a further actuator (not shown) such as an electric motor or stepper solenoid, for electronically controlling a position of the throttle valve 88 in proportion to the position of the lever 52 dictated by a user.

In addition to the sensors described above, additional sensors may be provided for detecting other conditions such as a knock sensor, a fuel pressure sensor, a back pressure sensor, a trim angle sensor, a mount height sensor, an engine vibration sensor, and a watercraft position sensor. Any combination of these sensors in combination with the above-mentioned sensors can be used with various known control strategies.

The ECU 106, as noted above, outputs signals to the fuel injectors 146, the spark plugs 152, for their respective control. Additionally, the ECU 106 can also control the high pressure fuel pump and the throttle valve 88. Additionally, the ECU 106 can be connected to various other components of the engine 20 including, for example, but without limitation, a lubrication pump (not shown), and a coolant fluid pump (not shown). As noted above, the ECU 106 can control these various components according to any known control strategy.

In the illustrated embodiment, the ECU 106 includes a memory 202. The memory 202 contains any number of various predetermined multi-dimensional maps or other types of software for controlling the various components of the engine 20 according to any known control strategy. Such maps are typically created through testing of a representative sample of an engine from a mass production line. The data and maps resulting from such testing are used as a basis by the electronic control units for all the engines produced by the mass production line, such as engine 20.

Figure 4:
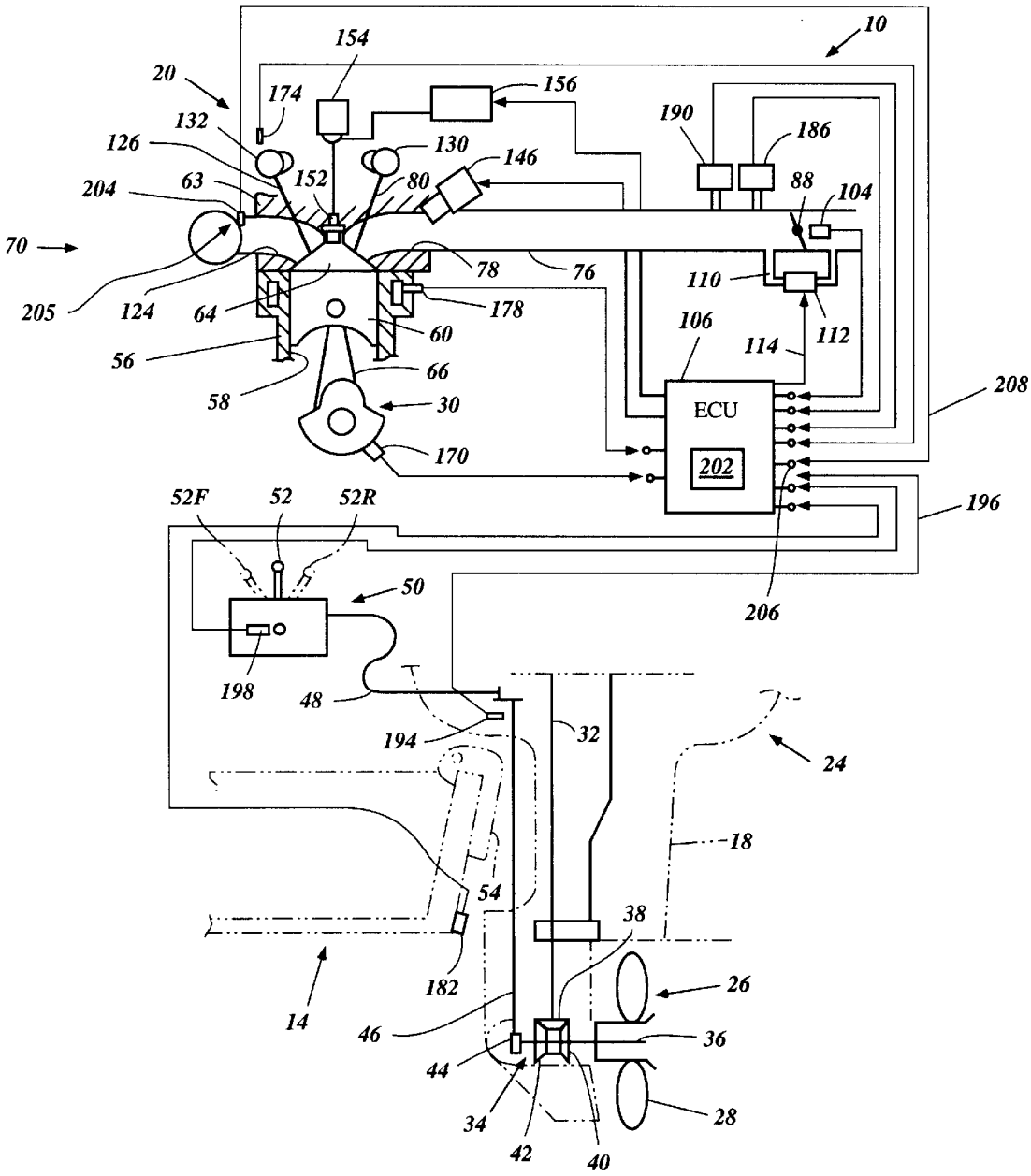
FIG. 4 includes the same views as FIG. 1 and additionally shows a combustion condition sensor connected to the exhaust system and to the ECU.

The present ECU 106 also includes at least one compensation value contained within the memory 202 that is used for controlling fuel injection which is derived from data recorded during a test of the engine 20. For example, with reference to FIG. 4, the present engine 20 is configured to receive a removable combustion condition sensor 204 so as to maintain the combustion condition sensor 204 in contact with exhaust gases from the combustion chamber 64. For example, the engine 20 can include a combustion condition sensor port 205 configured to receive a combustion condition sensor, such as an oxygen sensor. The engine preferable also includes a plug (not shown) for closing the combustion condition sensor port 205 when the engine 20 is running without combustion condition sensor 204 connected to the port 205.

Similarly, the ECU 106 preferably includes a releasable sensor input port 206. Preferably, the port 206 is independent of any other input port on the ECU 106 such that any data or signal line connected thereto can be disconnected independently of any other such input data line. In the illustrated embodiment, the transmission position sensor dataline 200 is typically connected to the sensor port 206 during normal operation of the engine 20. The combustion condition sensor data line 208 is preferably connected to an input port of the ECU 106 that is normally connected to a sensor which has a different output signal characteristic than the combustion condition sensor 204. By connecting the combustion condition sensor data line 208 as such, the ECU can more easily determine whether the combustion condition sensor 204 is connected to the input port 206 or whether another sensor is connected to the input port 206. In the present embodiment, the combustion condition sensor line 208 is connected to the input port 206 which, under normal running conditions, is connected to the transmission position sensor data line 200. Thus, since the output characteristics of the transmission position sensor 194 is different from a typical combustion condition sensor such as an oxygen sensor, the ECU 106 can readily determine whether the input port 206 is connected to the transmission position sensor 194 or an oxygen sensor used as the combustion condition sensor 204, discussed in more detail below. Thus, the ECU 106 desirably is configured to determine whether a combustion condition sensor 204 or another sensor having a different characteristic is connected to an input port, such as the input port 206.

With the combustion condition sensor 204 connected to the exhaust system 70, the ECU 106 can be operated in a feedback control mode during which engine operating conditions sensed by the various sensors including at least the combustion condition sensor 204, are recorded in order to determine optimal operating conditions of the engine 20. For example, the ECU 106 can be configured to run the engine 20 at a number of engine speeds. At each engine speed, the ECU can use the output signal from the combustion condition sensor 204 to determine the proper fuel injection duration needed to achieve a desired air/fuel ratio. Preferably, the ECU 106 will determine the fuel injection duration required to achieve a stocheometrically correct air/fuel mixture within the combustion chamber 64. Optionally, the ECU 106 can be configured to determine whether the engine 20 is operating at a predetermined test speed, thus relying on an operator to cause the engine to run at the predetermined test speed.

As noted above, the combustion condition sensor 204 can be any known combustion condition sensor capable of outputting a signal indicative of the air/fuel ratio of an air/fuel mixture delivered to the combustion chamber 64. In a presently preferred embodiment, the combustion condition sensor 204 is an oxygen sensor which can be constructed in accordance with any known oxygen sensor design. For example, the oxygen sensor can be constructed of a catalytic-type oxygen sensor. In this type of oxygen sensor, a sensor element of the oxygen sensor is constructed of a ceramic material such as zirconium oxide ($Z_rO_2$) housed in a gas-permeable platinum electrode. During operation, and in particular temperatures in excess of 300° C., the zirconium dioxide conducts negative oxygen ions. Such as sensors designed to be very responsive at Lambda (Λ), i.e., values in the vicinity of (1), i.e., the output signal changes quickly in response to small changes in the detected air/fuel ratio. For typical gasoline-powered engines, the stocheometrically ideal air/fuel ratio is about 15:1, and more particularly 14.7:1. As is common in the art, A is defined as equal to one (1) when the air/fuel ratio is 14.7:1. Thus, typical oxygen sensors for gasoline-powered internal combustion engines are configured to be very responsive when the air/fuel ratio is about 14.7:1.

A first electrode of the sensor is typically exposed to a reference value of atmospheric air. Thus, a greater quantity of oxygen ions will be present on the first electrode. Through the electrolytic action, the oxygen ions permeate the electrode and migrate through the electrolyte zirconium dioxide. Thus, a charge builds in the sensor as a function of the amount of oxygen ions that are present in the vicinity of the sensor element.

When the sensor element, i.e., the second electrode, is exposed to exhaust emissions formed as a result of the combustion of a rich air/fuel mixture, there is very little free oxygen in the exhaust gas. This small amount of oxygen is readily combined with carbon monoxide (CO) present in the exhaust gas through the catalytic action of the platinum electrode. Thus, the oxygen concentration in the exhaust gas is discharged after combustion of a rich air/fuel charge is relatively low, in contrast with the oxygen content of the atmosphere. Oxygen atoms contacting the atmospheric electrodes gain electrons and travel through the zirconium ceramic to the exhaust electrode where they then shed the extra electron, thus leaving a positive charge on the atmospheric electrode and a negative charge on the exhaust electrode. Through this mechanism, a small voltage of about 0.8 volts can be generated by the sensor.

Conversely, when the outer platinum electrode is subjected to the emissions of the combustion of a lean air/fuel charge, the concentration of free oxygen in the exhaust gas is relatively large. Thus, despite the oxidizing action of the platinum electrode, there is a relatively large amount of oxygen present in the exhaust gases exposed to the sensor element. Because there are oxygen ions present at both the exhaust electrode, i.e., the sensor element and the atmospheric electrode, little electromotive force is generated between the electrodes, thereby leaving a charge of approximately 0 volts in the sensor. Alternatively, other types of oxygen sensors can be used which generate different output voltages corresponding to the detection of rich or lean exhaust gases. Additionally, circuits can be connected to the oxygen sensors to manipulate the output voltages to other ranges.

Thus, during a test of the engine 20, the ECU 106 operates the fuel injectors 146 according to the predetermined map stored in the memory 202. The ECU 106 then adjusts the fuel injection duration until corrected fuel injection duration is reached which corresponds to a pre-determined air/fuel ratio, as indicated by the output from the combustion condition sensor 204. Preferably, the ECU 106 will determine the corrected fuel injection duration required to achieve a stocheometrically correct air/fuel ratio, i.e., Λ values equal to approximately 1. The ECU 106 preferably stores the corrected fuel injection duration as a compensation value (C). Preferably, the compensation value (C) is a percentage of the fuel injection duration dictated by the predetermined map, i.e, +C% for corrected fuel injection duration values greater than that defined in the predetermined map and −C% for corrected fuel injection duration values smaller than defined in the predetermined map.

After determining the corrected fuel injection durations, or compensation values (C%) for a plurality of engine speeds, the ECU 106 generates a map defining a relationship between corrected fuel injection duration and engine speed. Preferably, the map defines a relationship between compensation values (C%) and engine speed.

Thus, by configuring the ECU 106 as noted above, the map created by the ECU 106 is derived from a test of the engine 20. Thus, the data used to generate the map allows the ECU 106 to compensate for discrete differences or variations that can be generated in identical mass-produced engines. For example, as noted above, fuel injectors typically include a valve at the injection nozzle which is biased to a closed position by a spring. A solenoid acts against the bias of the spring to open the fuel injector according to the fuel injection duration determined the ECU 106. 1However, the closing of the valve is dependent on the spring constant of the spring. Thus, variations caused during mass production of the spring affects the performance, and particularly, the actual fuel injection duration performed by the fuel injector 146. Because fuel injection duration can be affected by the spring, the spring can thereby affect the air/fuel ratio of the air/fuel charge delivered to the combustion chamber 64.

Thus, by including a map within the ECU 106 that is derived from data recorded during a test of the engine 20, the ECU can compensate for such a variation in the engine components and thereby can more reliably produce air/fuel charges having any desired air/fuel ratio, without the need for a combustion condition sensor to be connected to the engine at all times.

As noted above, oxygen sensors are expensive. Thus, by constructing the ECU 106 as such and thereby avoiding the need for a combustion condition sensor such as an oxygen sensor, to be present in the engine during operation, the engine 20 can be manufactured more inexpensively. Additionally, as noted above, oxygen sensors are particularly sensitive to corrosion caused by contact with water, due to at least in part, the various dissimilar metals used to construct a typical oxygen sensor. Additionally, because oxygen sensors are most conveniently mounted in an exhaust system, contact with water or water vapor is likely when an oxygen sensor is used with an engine for a marine vehicle which commonly discharge exhaust gases below water, and/or inject water directly into the exhaust system.

Figure 5:
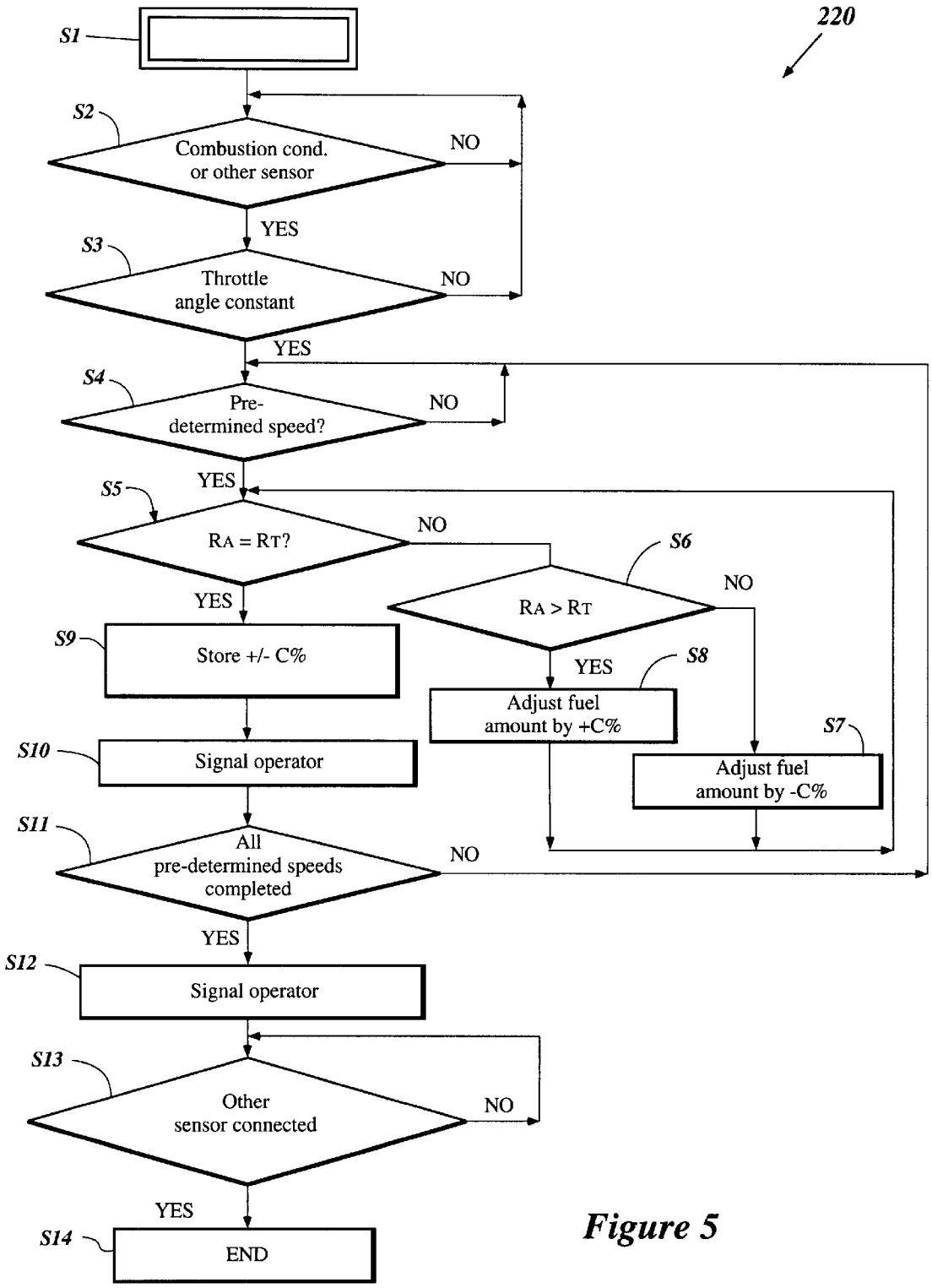
FIG. 5 is a flow diagram of a control subroutine for adjusting an engine controller.

FIG. 5 illustrates a control subroutine 220 for practicing the present control scheme for the engine 20. The control subroutine 220 is initiated by an operator, or automatically, at a step S1. As noted above, when an engine such as the engine 20, whether it is packaged as part of an outboard motor such as the outboard motor 10, or within the engine compartment of another marine vehicle, such as a personal watercraft, small jet boat, or an inboard/outboard watercraft, the ECU 106 will be provided with any one of numerous known maps that are used for various control strategies, including fuel injection control. Such a map is typically based on a test run of a sampling of engines that have been mass produced.

After initiation, and preferably after the engine has been started and is running, the subroutine moves on to a step S2. At the step S2, the subroutine 220 determines whether the ECU 106 is connected to the combustion condition sensor 204 or another sensor having a different output characteristic. For example, the ECU 106 can compare the voltage signal received at sensor input port 206 to known voltage ranges associated with the combustion condition sensor 204.

Figure 6:
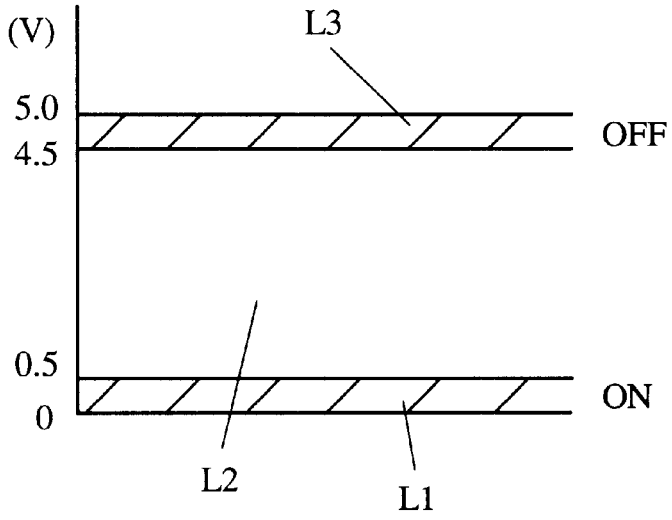
FIG. 6 is a graph having voltage (V) plotted on the vertical axis and illustrating three voltage ranges, i.e., a low range, an intermediate range, and a high range.

With reference to FIG. 6, three reference voltage ranges are illustrated therein. As shown in FIG. 6, a low level voltage range L1 is defined as a voltage between 0 and 0.5 volts. An intermediate voltage range L2 is defined as voltages between 0.5 and 4.5 volts. A high voltage range L3 is defined as voltages between 4.5 and 5.0 volts. It has been found that using certain transmission position sensors and oxygen sensors, the ECU 106 can discriminate between an oxygen sensor and transmission position sensors, depending on the voltage output therefrom. For example, as shown in FIG. 6, if the voltage at the sensor input port 206 is below 0.5 volts, the ECU can assume that the transmission position sensor 194 is connected to the sensor input port 206 and that the transmission 34 is in neutral. If the voltage at the sensor input port 206 is between 4.5 and 5.0 volts, i.e., in the high voltage range L3, the ECU 106 can also assume that the transmission position sensor 194 is connected to the sensor input port 206 and that the transmission 34 is in either forward or reverse gear. However, if the voltage at the sensor input port 206 is between 0.5 and 4.5 volts, the ECU 106 can assume that the combustion condition sensor 204 is connected to the sensor input port 206. These "assumptions" are correct since the illustrated transmission position sensor 194 only reflects two states, i.e., "on" or "off." Thus, by using an oxygen sensor which outputs voltages only between 0.5 and 4.5 volts, such an oxygen sensor can be connected to the same sensor input port as that normally used for the transmission position sensor 194. As such, the number of sensor input ports of the ECU 106 can be reduced, thereby reducing the cost of the ECU 106.

If it is determined that the combustion condition sensor 204 is not connected to the ECU 106, the subroutine 220 returns to step S2 and repeats. If, however, it is determined that the combustion condition sensor 204 is connected to the input sensor port 206, the subroutine moves on to a step S3.

At the step S3, the subroutine 220 determines whether the position of the throttle valve 88 is constant. For example, the ECU 106 can sample the output from the throttle position sensor 104 over time, to determine if the throttle valve is being maintained in a substantially constant position. If it is determined that the throttle angle is not constant, i.e., the throttle valve 88 is moving, control subroutine 220 returns to step S2 and repeats. If, however, it is determined that the throttle angle is constant, the subroutine 220 moves on to a step S4. As such, the control subroutine 220 prevents analysis of the engine operating conditions when the engine speed is being accelerated or decelerated, thereby avoiding potentially erroneous results.

At the step S4, the control subroutine 220 determines whether the crankshaft 30 is rotating at a predetermined speed. For example, the ECU 106 can sample the output of the engine speed sensor 170 to determine if the crankshaft 30 is rotating at a predetermined speed. Preferably, the subroutine 220 is performed at a plurality of different engine speeds over the normal operating engine speed range for the engine 20. If it is determined that the speed of the engine is not a predetennined speed, the control subroutine 220 returns to the step S4 and repeats. If it is determined that the engine speed is a predetermined engine speed, the subroutine 220 moves on to a step S5.

Optionally, the ECU 106 can be configured to change the speed of the engine automatically, to the predetermined speeds. For example, as noted above with respect to the throttle lever position sensor 198, the ECU 106 can be configured to control the position of the throttle valve by an electric motor or a stepper solenoid. Thus, in this mode, the ECU can be configured to adjust the throttle valve 88 position to achieve the predetermined engine speeds.

At the step S5, the subroutine 220 determines whether the actual air/fuel ratio $R_A$ equals the target air/fuel ratio $R_T$. For example, the ECU 106 can sample the output from the combustion condition sensor 204 to determine the actual air/fuel ratio $R_A$ of the air/fuel charge combusted in the combustion chamber 64. Preferably, the target air/fuel ratio $R_T$ will correspond to a Λ value of 1, i.e., 14.7:1. However, it is conceived that the present invention can be used with engines having control strategies that utilize a lean burning mode. Thus, other target air/fuel ratios $R_T$ can be used. If it is determined that the actual air/fuel ratio $R_A$ is not equal to the target air/fuel ratio $R_T$, the control subroutine 220 moves on to a step S6.

At the step S6, the control subroutine 220 determines whether the actual air/fuel ratio $R_A$ is greater than the target air/fuel ratio $R_T$. If it is determined that the actual air/fuel ratio $R_A$ is not greater than the target air/fuel ratio $R_T$, the subroutine 220 moves on to a step S7.

At the step S7, the amount of fuel injected by the fuel injectors 146 is adjusted by compensation factor of −C%. Thus, since it was determined, in the step S6, that the actual air/fuel ratio $R_A$ was not greater than the target air/fuel ratio $R_T$, it is assumed that the actual air/fuel ratio $R_A$ is less than the target air/fuel ratio $R_T$. Thus, by adjusting the amount of fuel injected by the fuel injectors 146 by compensation factor of −C%, the air/fuel charge delivered to the combustion chambers 64 is made more lean. After the step S7, the subroutine 220 returns to the step S5.

If, at the step S6, it is determined that the actual air/fuel ratio $R_A$ is greater than the target air/fuel ratio $R_T$, the control subroutine 220 moves on to a step S8. At the step S8, the amount of fuel injected by the fuel injectors 146 is increased by a compensation factor of +C%. Thus, the air/fuel ratio of the air/fuel charges delivered to the combustion chambers 64 is made more rich, thereby lowering the actual air/fuel ratio $R_A$. After the step S8, the control subroutine 220 returns to the step S5. If it is determined that the actual air/fuel ratio $R_A$ does not equal the target air/fuel ratio $R_1$, the control subroutine 220 will repeat steps S6–S8 as necessary until a final compensation factor, i.e., +C% or −C% is reached which results in an actual air/fuel ratio $R_A$ that equals the target air/fuel ratio $R_T$. If the actual air/fuel ratio $R_A$ equals the target air/fuel ratio $R_T$ at step S5, the control subroutine 220 moves on to a step S9.

At the step S9, the compensation factor ±C% is stored in the ECU 106. For example, the ECU 106 can store the compensation factor ±C% in the memory 202 or another memory. Preferably, the ECU 106 stores compensation factors +C in a two-dimensional map such as the two-dimensional map illustrated in FIG. 7, discussed in more detail below with reference to FIG. 7. After the compensation factor ±C% is stored, the subroutine 220 moves on to a step S10.

At the step S10, the control subroutine 220 signals the operator that the compensation value has been stored. For example, the control subroutine 220 can cause the ECU or any other electrical component to energize a buzzer and/or a lamp for a first period of time. After the step S10, the control subroutine 220 moves on to a step S11.

At the step S11, the control subroutine 220 determines whether all of the predetermined speeds have been completed. For example, as noted above, the control subroutine 220 can be configured to repeat steps S4–S10 for a plurality of engine speeds. If it is determined that all the predetermined speeds have not been completed, the subroutine 220 returns to step S4 and repeats.

Figure 7:
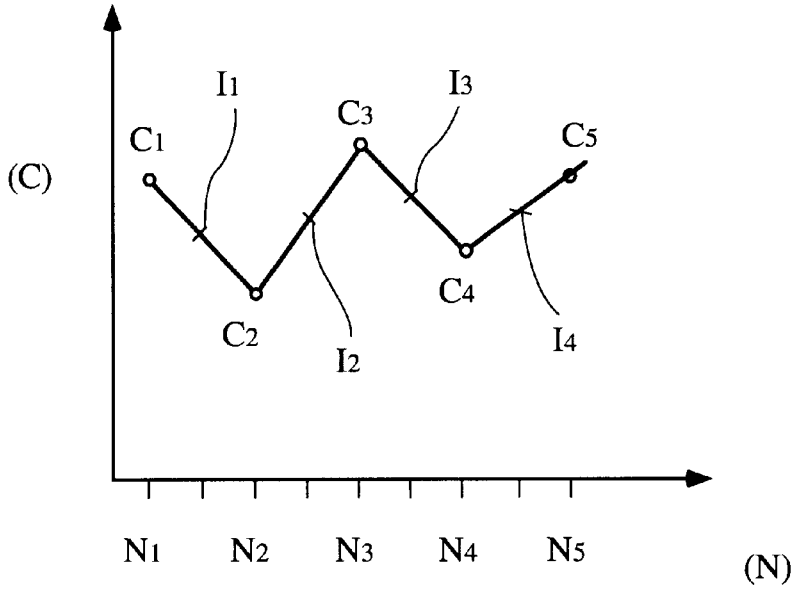
FIG. 7 is a graph having a compensation value (C) plotted on the vertical axis and engine speed (N) plotted on the horizontal axis.

With reference to FIG. 7, as the subroutine 220 repeats steps S4–S11, the subroutine 220 causes a plurality of compensation factors, such as $C_1$, $C_2$, $C_3$, $C_4$, and $C_5$, for example. The compensation factors $C_1$–$C_5$ represent actual compensation factors stored during the steps S5–S11, and correspond to engine speeds of $N_1$–$N_5$, respectively, as illustrated in FIG. 7. Preferably, the ECU 106 also generates interperlations $I_1$, $I_2$, $I_3$, and $I_4$ between the compensation factors $C_1$ and $C_2$, $C_2$ and $C_3$, $C_3$ and $C_4$, and $C_4$ and $C_5$, respectively. The combination of the interperlations $I_1$–$I_4$ and the compensation factors $C_1$–$C_5$, respectively, thereby defining a relationship between a compensation factor C and engine speed N. Thus, during normal operation of the engine 20 after the combustion condition sensor 204 has been removed, the engine 20 can operate using the predetermined control map, as noted above, along with the relationship between compensation factor C and engine speed N illustrated in FIG. 7 to correct the fuel injection amount and thereby more accurately generate the desired air/fuel ratio within the combustion chamber 64.

With reference to FIG. 5, if it is determined, at the step S11, that all of the predetermined speeds have been completed, the subroutine 220 moves on to a step S12.

At the step S12, the subroutine 220 signals the operator. For example, the subroutine 220 can cause the ECU 106 to energize a lamp and/or a buzzer for a second period of time. Preferably, the second period of time is longer than the first period of time, noted above with respect to the step S10. Thus, an operator can distinguish between signals generated after the storing of individual compensation factors and the completion of all of the predetermined engine speeds. Optionally, the control subroutine 220, at the step S12, can instruct the ECU 106 to store the interperlations $I_1$–$I_4$ illustrated in FIG. 7. After the step S12, the subroutine 220 moves on to a step S13.

At the step S13, the subroutine 220 determines whether the combustion condition sensor is disconnected and another sensor is connected. For example, the subroutine 220 can cause the ECU 106 to sample the output at the sensor input port 206 and determine whether the voltage thereat is less than 0.5 volts, i.e., in the low voltage range, or if the voltage at the sensor input port 206 is above 4.5 volts, i.e., the high voltage range. If it is determined that another sensor has not been connected, the subroutine 220 returns to step S13 and repeats. If, however, it is determined that another sensor has been connected, the subroutine 220 moves on to a step S14 and ends thereat.

After performing the control subroutine 220, the combustion condition sensor 204 is preferably removed from the port 205. Thus, after removal of the combustion condition sensor 204, the plug noted above, is preferably installed to close the port 205.

It is conceived that a control subroutine 220 can be used with any vehicle using an internal combustion engine, such as, for example, but without limitation, personal watercraft, small jetboats, off-road vehicles, circle track racing vehicles, automobiles, and heavy construction equipment.

As noted above, by installing a combustion condition sensor and running a test of the engine 20 to adjust the fuel injection amount injected by the fuel injectors 146, the present invention can compensate for variations in engine components that are mass produced, without the need for including a combustion condition sensor at all times during operation, while accurately producing a desired air/fuel ratio in the combustion chambers 64 of the engine 20. Thus, the overall cost of the engine 20 can be reduced. Furthermore, since the combustion condition sensor 204 is not disposed in the engine during operation, the combustion condition sensor 204 is not exposed to the damaging effects of water which have been found to be particularly destructive to typical oxygen sensors.

Additionally, by configuring the ECU to "learn" to compensate an amount of fuel injected by the fuel injectors 146, as noted above, it is conceived that the ECU 106 can "relearn" compensation values an unlimited number of times over the useful lifespan of the engine 20. For example, the control subroutine 220 can be performed during an annual tune-up of the engine 20. Thus, as the various engine components within the engine 20 age and experience wear or otherwise experience changes in performance which can affect the ability of the fuel injection system 68 to generate the desired air/fuel ratio within the combustion chamber 64, the ECU 106 can compensate for these additional variations.

It is to be noted that the ECU 106 may be in the form of a hard wired feedback control circuit configured to perform the subroutine 220. Alternatively, the ECU 106 may be constructed of a dedicated processor and a memory for storing a computer program configured to perform the steps S1–S14. Additionally, the ECU 106 may be constructed of a general purpose computer having a general purpose processor and a memory for storing a computer program for performing the subroutine 220.

Of course, the foregoing description is that of certain features, aspects and advantages of the present invention to which various changes and modifications may be made without departing from the spirit and scope of the present invention.

Moreover, one engine for a marine vehicle may not feature all objects and advantages discussed above to use certain features. aspects and advantages of the present invention. Thus, for example, those skilled in the art will recognize that the invention may be embodied or carried out in a manner that achieves or optimizes one advantage or group of advantages as taught herein without necessarily achieving other objects or advantages as may be taught or suggested herein. The present invention, therefore, should only be defined by the appended claims.

What is claimed is:

1. An engine comprising an engine body, a fuel supply system configured to supply fuel to the engine body, the fuel supply system including at least a first air/fuel charge former, and a controller configured to control operation of the first air/fuel charge former based on output received from a sensor connected to the engine, a memory configured to store a plurality of outputs of the sensor, the controller being further configured to control operation of the fuel supply system without the sensor being connected to the engine, based on the stored outputs of the sensor when the sensor was connected to the engine.

2. The engine according to claim 1, wherein the sensor is an air/fuel sensor.

3. The engine according to claim 1, wherein the sensor is an oxygen sensor.

4. The engine according to claim 1, wherein the memory comprises a map configured to store data received from the sensor and to operate the engine based on the stored data.

5. The engine according to claim 1, additionally comprising a map defining a relationship between a fuel supply parameter and a first engine operation parameter, the controller being configured to determine compensation values corresponding to the first engine operation parameter based on the output from the sensor.

6. An engine for a marine vehicle comprising an engine body defining at least one combustion chamber, a fuel-injection system including at least one fuel injector for forming fuel charges for combustion in the combustion chamber, an induction system for delivering air to the combustion chamber for combustion with the fuel charges, a controller connected to the fuel injector and configured to control operation of the fuel injector, the controller having a memory, the memory including a predetermined map defining fuel injection duration as a function of at least one engine operation characteristic and at least one compensation value derived from an actual air/fuel ratio of combustion gases from the engine detected by an air/fuel ratio sensor, the controller being configured to control operation of the engine without an air/fuel ratio sensor connected to the controller.

7. The engine according to claim 6 additionally comprising a two-dimensional map defining a plurality of fuel injection compensation values as a function of engine speed.

8. An engine for a marine vehicle comprising an engine body defining a plurality of combustion chambers, an exhaust system for guiding exhaust gases from the combustion chambers to the atmosphere, a fuel-injection system including a plurality of fuel injectors for delivering fuel charges to the combustion chambers, an induction system for delivering air to the combustion chambers for combustion with the fuel charges, a throttle valve disposed in the induction system for controlling an amount of air entering the combustion chambers when the engine is operating, an oxygen sensor mount configured to receive an oxygen sensor and suspend an oxygen sensor in contact with exhaust gases produced through combustion of the induction air and fuel charges in the combustion chambers, a controller connected to the fuel injectors and configured to control injection timing and duration of fuel injection from the fuel injectors, the controller having a memory, the memory including a predetermined multi-dimensional map defining fuel injection duration and timing as a function of at least engine speed and throttle position, the controller also including a two-dimensional map defining fuel injection duration compensation values as a function of engine speed, the relationship between fuel injection duration compensation values and engine speed being derived from data recorded during a test of the engine with an oxygen sensor disposed in the oxygen sensor mount, the controller being configured to operate the engine without an oxygen sensor disposed in the oxygen sensor mount during normal operation.

9. An engine for a marine vehicle comprising an engine body defining at least one combustion chamber, a fuel-injection system including at least one fuel injector for forming fuel charges for combustion in the combustion chamber, an induction system for delivering air to the combustion chamber for combustion with the fuel charges, a controller connected to the fuel injector and configured to control operation of the fuel injector, the controller having a memory, the memory including a predetermined map defining fuel injection duration as a function of at least one engine operation characteristic and at least one compensation value derived from an actual air/fuel ratio of combustion gases from the engine, and a releaseable input signal port provided on the controller.

10. The engine according to claim 9, wherein the releasable input signal port is independent of any other input port on the controller.

11. The engine according to claim 9, wherein the controller is configured to determine whether a combustion condition sensor or another sensor is connected to the releasable port.

12. The engine according to claim 9, wherein the controller is configured to determine the type of sensor connected to the releasable port based on the output signal characteristic detected thereat.

13. An engine for a marine vehicle comprising an engine body defining at least one combustion chamber, a fuel-injection system including at least one fuel injector for forming fuel charges for combustion in the combustion chamber, an induction system for delivering air to the engine body for mixing with the fuel charges to form an air/fuel charge for combustion in the combustion chamber, a throttle valve disposed in the induction system for controlling an amount of air entering the combustion chambers when the engine is operating, a controller connected to the fuel injector and configured to control operation of the fuel injector, the controller including a memory having a predetermined map defining a relationship between fuel injection duration and at least one engine operation characteristic, the controller being configured to determine an air fuel ratio of an air/fuel charge combusted in the combustion chamber, determine at least one compensation value for adjusting a fuel injection duration value in the predetermined map to achieve a predetermined air/fuel ratio, store the compensation value, the controller being configured to operate the fuel injection system based on the map and the stored compensation value, without an air/fuel ratio sensor being installed on the engine.

14. The engine according to claim 13, wherein the controller is configured to store a plurality of compensation values for a plurality of respective engine speeds.

15. The engine according to claim 14, wherein the controller is configured to interpolate between the plurality of compensation factors to define a relationship between compensation factors and engine speed over an engine speed range.

16. The engine according to claim 13, wherein the controller is configured to emit a first signal indicating that a compensation factor has been determined.

17. The engine according to claim 16, wherein the controller is configured to emit the first signal for a first predetermined period of time.

18. The engine according to claim 17, wherein the controller is configured to emit a second signal indicating that a plurality of compensation values have been stored, and to emit the signal for a second period of time being greater than the first period of time.

19. An engine for a marine vehicle comprising an engine body defining at least one combustion chamber, a fuel-injection system including at least one fuel injector for forming fuel charges for combustion in the combustion chamber, an induction system for delivering air to the engine body for mixing with the fuel charges to form an air/fuel charge for combustion in the combustion chamber, a throttle valve disposed in the induction system for controlling an amount of air entering the combustion chambers when the engine is operating, a controller connected to the fuel injector and configured to control operation of the fuel injector, the controller including a memory having a predetermined map defining a relationship between fuel injection duration and at least one engine operation characteristic, the controller including means for determining a plurality of compensation values as a function of engine speed and output from an engine operation characteristic sensor configured to detect the at least one engine operation characteristic for adjusting the fuel injection duration values defined in the predetermined map, and means for operating the engine without the engine operation characteristic sensor being connected to the engine.

20. An engine for a marine vehicle comprising an engine body defining at least one combustion chamber, a fuel-injection system including at least one fuel injector for forming fuel charges for combustion in the combustion chamber, an induction system for delivering air to the engine body for mixing with the fuel charges to form an air/fuel charge for combustion in the combustion chamber, a throttle valve disposed in the induction system for controlling an amount of air entering the combustion chambers when the engine is operating, a controller connected to the fuel injector and configured to control operation of the fuel injector, the controller including a memory having a predetermined map defining a relationship between fuel injection duration and at least one engine operation characteristic, the controller including means for determining an air fuel ratio of an air/fuel charge combusted in the combustion chamber, means for determining at least one compensation value for adjusting a fuel injection duration value in the predetermined map to achieve a predetermined air/fuel ratio, means for storing the compensation value, and means for operating the fuel injection system based on the map and the stored compensation value, without an air/fuel ratio sensor being installed on the engine.

21. The engine according to claim 20 additionally comprising means for interpolating between a plurality of the compensation values to define a relationship between compensation values and engine speed over an engine speed range.

22. The engine according to claim 20 dditionally comprising means for signaling an operator when a compensation value has been determined.

23. The engine according to claim 20 additionally comprising means for signaling an operator when a plurality of compensation values has been determined for a desired plurality of engine speeds.

24. A method for adjusting a fuel injector controller of a fuel-injected marine vehicle engine which includes at least one combustion chamber and a fuel injection system, the method comprising the steps of operating the fuel injection system according to a predetermined map defining fuel injection operation parameters, detecting an air/fuel ratio of an air/fuel charge combusted within a combustion chamber of the engine, comparing the detected air/fuel ratio with a target air/fuel ratio, determining a compensation value for a fuel injection parameter if the detected air/fuel ratio is not the target air/fuel ratio, storing the compensation value, and determining if an air/fuel ratio sensor is connected to the controller.

25. A method for adjusting a fuel injector controller of a fuel-injected marine vehicle engine which includes at least one combustion chamber and a fuel injection system, the method comprising the steps of operating the fuel injection system according to a predetermined map defining fuel injection operation parameters, detecting an air/fuel ratio of an air/fuel charge combusted within a combustion chamber of the engine, comparing the detected air/fuel ratio with a target air/fuel ratio, determining a compensation value for a fuel injection parameter if the detected air/fuel ratio is not the target air/fuel ratio, storing the compensation value, and determining a type of a sensor connected to the controller by comparing an output signal characteristic of the sensor with predetermined voltage ranges.

26. A method for adjusting a fuel injector controller of a fuel-injected marine vehicle engine which includes at least one combustion chamber and a fuel injection system, the method comprising the steps of operating the fuel injection system according to a predetermined map defining fuel injection operation parameters, detecting an air/fuel ratio of an air/fuel charge combusted within a combustion chamber of the engine, comparing the detected air/fuel ratio with a target air/fuel ratio, determining a compensation value for a fuel injection parameter if the detected air/fuel ratio is not the target air/fuel ratio, and storing the compensation value, wherein the predetermined map comprises a multi-dimensional map stored in a memory of a controller connected to the fuel injection system of the engine, the map defining at least one relationship between fuel injection duration and a second engine operation characteristic.

27. A method for adjusting a fuel injector controller of a fuel-injected marine vehicle engine which includes at least one combustion chamber and a fuel injection system, the method comprising the steps of operating the fuel injection system according to a predetermined map defining fuel injection operation parameters, detecting an air/fuel ratio of an air/fuel charge combusted within a combustion chamber of the engine, comparing the detected air/fuel ratio with a target air/fuel ratio, determining a compensation value for a fuel injection parameter if the detected air/fuel ratio is not the target air/fuel ratio, and storing the compensation value, wherein the step of determining a compensation value comprises determining a plurality of compensation values.

28. The method according to claim 27 additionally comprising interpolating between the plurality of compensation values to define a relationship between the compensation values and the second engine operation characteristic over a range of values of the second engine operation characteristic.

* * * * *